US008454372B2

(12) United States Patent
Lee et al.

(10) Patent No.: US 8,454,372 B2
(45) Date of Patent: Jun. 4, 2013

(54) ELECTRICAL CONNECTOR WITH POWER PLUG AND POWER SOCKET

(75) Inventors: Chun-Lang Lee, New Taipei (TW); Bin Dai, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/294,397

(22) Filed: Nov. 11, 2011

(65) Prior Publication Data

US 2012/0309210 A1 Dec. 6, 2012

(30) Foreign Application Priority Data

Jun. 1, 2011 (CN) ..... 2011 1 014573

(51) Int. Cl.
*H01R 11/30* (2006.01)

(52) U.S. Cl.
USPC ..... 439/38; 200/51.09

(58) Field of Classification Search
USPC ..... 439/38, 188; 200/51 R, 51.09
See application file for complete search history.

(56) References Cited

U.S. PATENT DOCUMENTS 2,573,920 A * 11/1951 McLeod ..... 200/51.09
3,144,527 A * 8/1964 Tolegian ..... 200/51.09
3,159,725 A * 12/1964 Dennis ..... 200/51.09
3,521,216 A * 7/1970 Tolegian ..... 439/39
3,816,679 A * 6/1974 Hotchkiss ..... 200/51.09
3,868,160 A * 2/1975 Kersman ..... 439/39
4,242,657 A * 12/1980 Chaillot ..... 335/207
4,317,969 A * 3/1982 Riegler et al. ..... 200/52 R
4,451,113 A * 5/1984 Zuniga ..... 439/40
4,491,792 A * 1/1985 Bullock et al. ..... 324/157
5,829,987 A * 11/1998 Fritsch et al. ..... 439/38
5,921,783 A * 7/1999 Fritsch et al. ..... 439/38
6,030,229 A * 2/2000 Tsutsui ..... 439/39
6,183,264 B1 * 2/2001 Harsanyi ..... 439/38
6,213,783 B1 * 4/2001 Kankkunen ..... 439/39
6,231,349 B1 * 5/2001 Bullinger et al. ..... 439/39
6,495,775 B2 * 12/2002 Lawson et al. ..... 200/50.28
6,561,815 B1 * 5/2003 Schmidt ..... 439/38
6,966,781 B1 * 11/2005 Bullinger et al. ..... 439/38
7,645,143 B2 * 1/2010 Rohrbach et al. ..... 439/39
7,936,242 B2 * 5/2011 Carpenter ..... 335/205
7,997,906 B2 * 8/2011 Ligtenberg et al. ..... 439/38
2012/0309210 A1 * 12/2012 Lee et al. ..... 439/39

* cited by examiner

*Primary Examiner* — Ross Gushi
(74) *Attorney, Agent, or Firm* — Altis Law Group, Inc.

(57) ABSTRACT

An electronic device includes a power plug and a power socket coupled to the power plug. The power plug includes a housing, two plug contacts, one conductive member, two conductive resilient pieces, and two magnetic members. The conductive resilient pieces are positioned in the housing, and are electrically connected to the conductive member. The magnetic members are positioned in the housing, and opposite to the at least two conductive resilient pieces. The power socket includes an inner housing, two socket contacts, and two metal pieces. The inner housing defines an assembly groove to receive the power plug. The metal pieces are positioned in the assembly groove of the inner housing, and are opposite to the magnetic members, such that a magnetic attraction force exerted between the metal pieces and the magnetic member actuates the power plug.

20 Claims, 7 Drawing Sheets

ELECTRICAL CONNECTOR WITH POWER PLUG AND POWER SOCKET

BACKGROUND

1. Technical Field

The present disclosure generally relates to electrical connectors, and particularly, to an electrical connector with a power plug and a power socket.

2. Description of the Related Art

A power wire is used for connecting an electronic device and a power supply, such that the electronic device is powered by the power supply. The power wire generally has a first plug and a second plug on opposite ends thereof, and the first plug and the second plug are exposed to the outside environment without any protective sleeve. However, when the first plug is connected to the power supply, and the second plug is not connected to anything, electricity from the power supply may pass to the outside via the second plug. Under damp or in certain other conditions, or by simple mishandling, accidents caused by electric shock may occur.

Therefore, there is room for improvement within the art.

BRIEF DESCRIPTION OF THE DRAWING

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
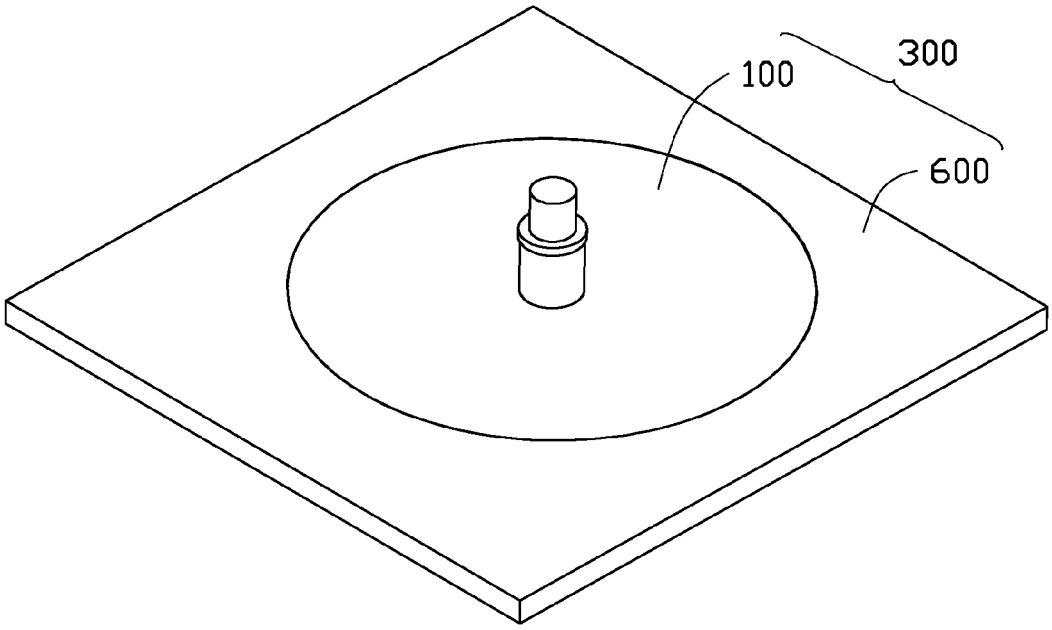
FIG. 1 is an isometric view of an embodiment of an electrical connector including a power plug and a power socket.
Figure 2:
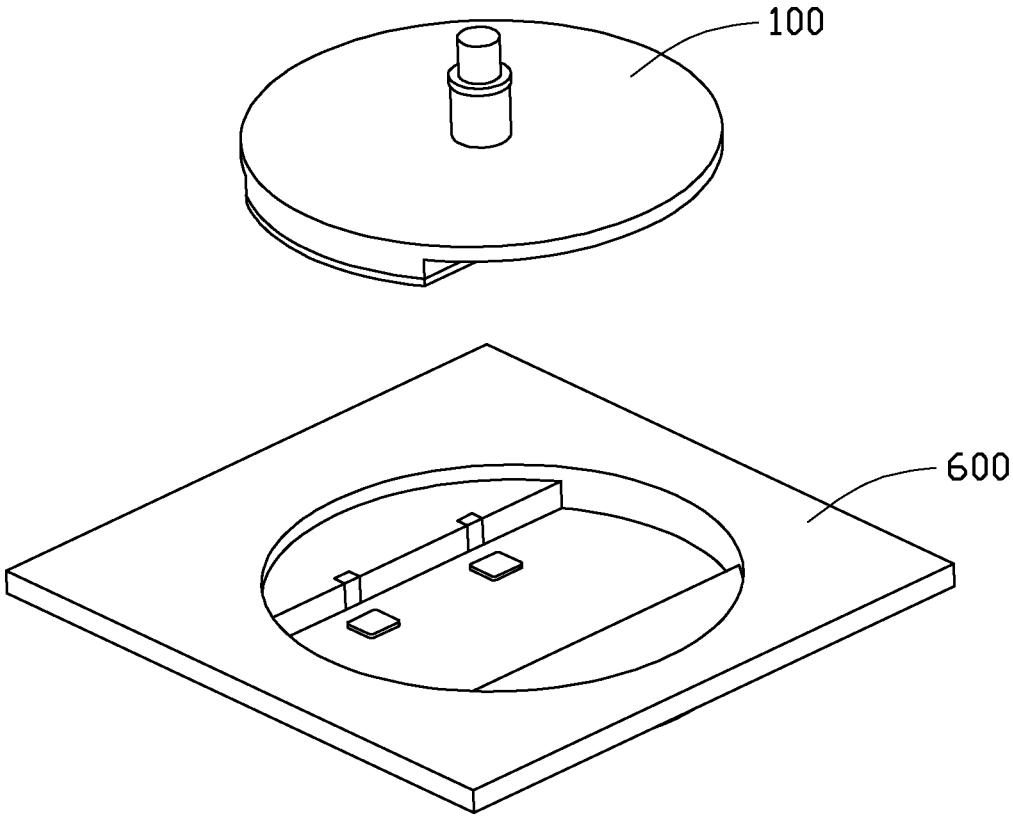
FIG. 2 is an exploded, isometric view of the electrical connector of FIG. 1.

Referring to FIGS. 1 and 2, an embodiment of an electrical connector 300 includes a power plug 100 and a power socket 600. In use, the power socket 600 is positioned on an electronic device (not shown), and the power plug 100 is electrically connected to a power wire (not shown) which is connected to a power supply (not shown).

Figure 3:
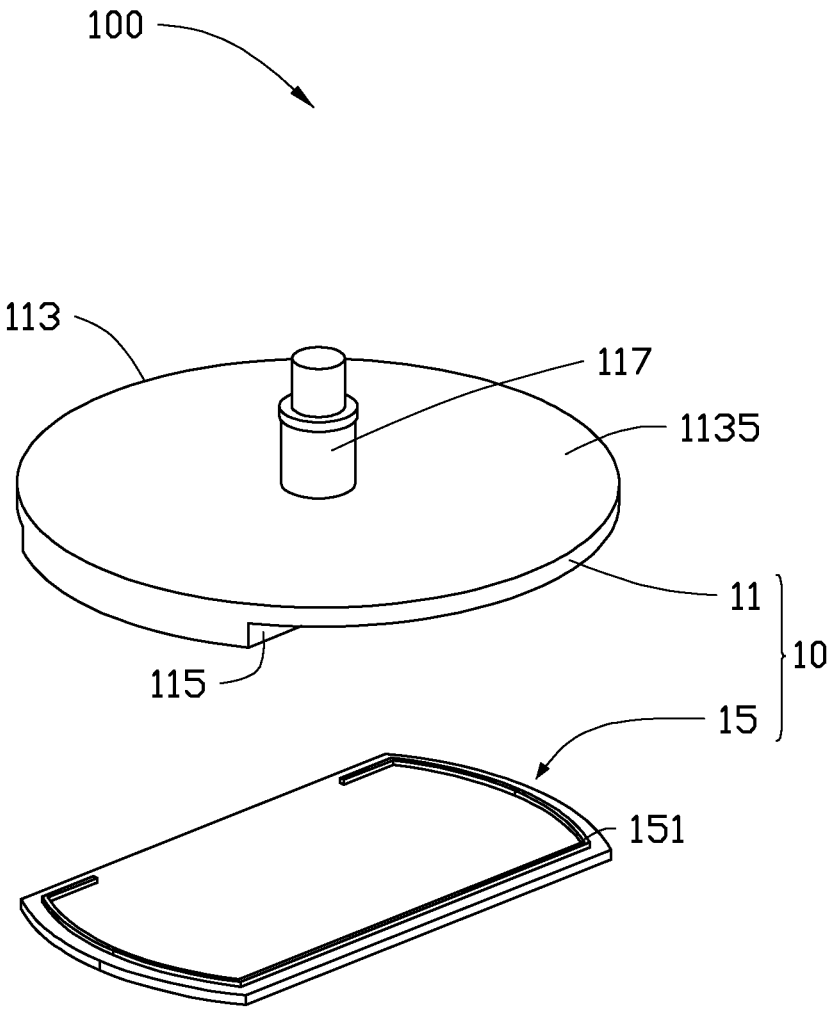
FIG. 3 is an exploded, isometric of the power plug of FIG. 1.
Figure 4:
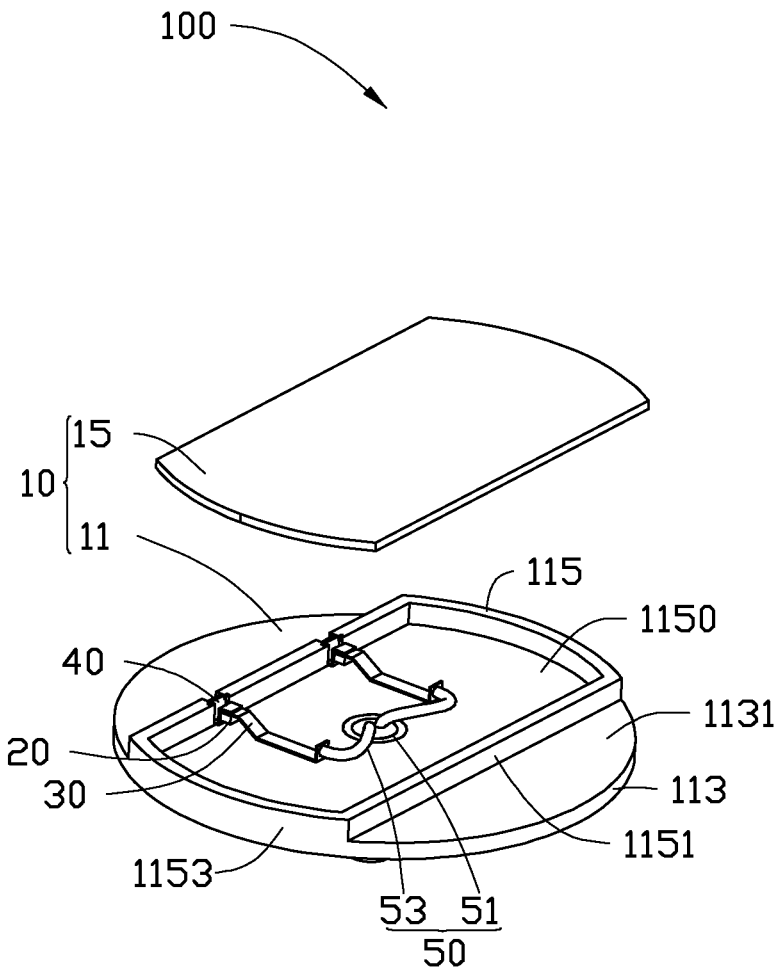
FIG. 4 is similar to FIG. 3, but viewed from another aspect.
Figure 5:
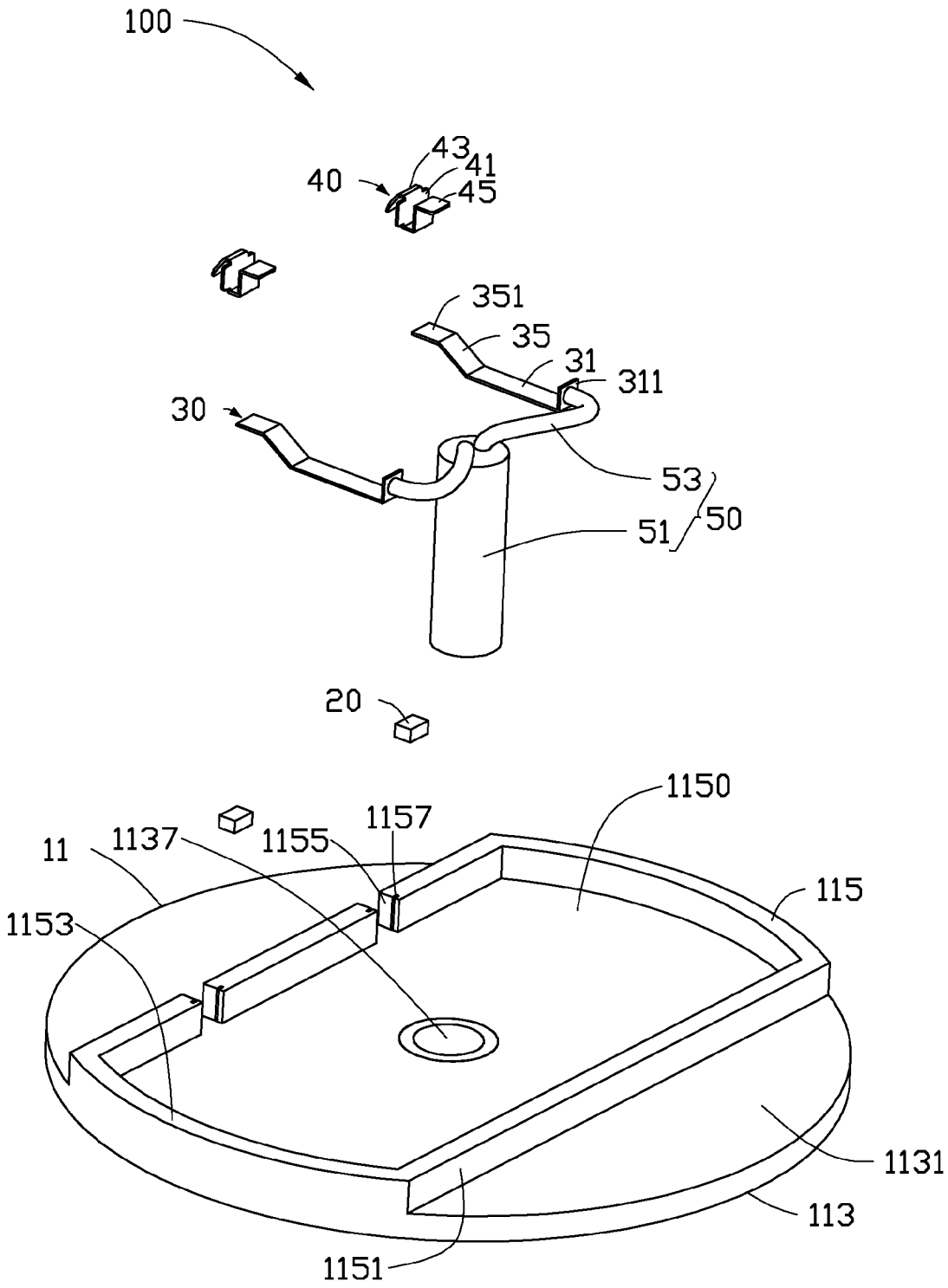
FIG. 5 is an exploded, isometric of the power plug of FIG. 4 without a cover.

Referring to FIGS. 3 through 5, the power plug 100 includes a housing 10, two magnetic members 20, two resilient pieces 30, two plug contacts 40, and a conductive member 50. It should be understood that, the power plug 100 may include three or more plug contacts 40, and correspondingly, the power plug 100 would have three or more magnetic members 20 and three or more resilient pieces 30.

The housing 10 includes a main body 11 and a cover 15 connected to the main body 11. The main body 11 and the cover 15 are made of insulating materials, such as plastic. The main body 11 includes a circular connecting portion 113, a frame portion 115, and a positioning protrusion 117. The connecting portion 113 includes a first surface 1131 and a second surface 1135 opposite to the first surface 1131. An assembly hole 1137 is substantially formed at the center of the first surface 1131. The frame portion 115 is formed on the first surface 1131 and surrounds the assembly hole 1137. The frame portion 115 and the connecting portion 113 cooperatively define a receiving groove 1150 for receiving the magnetic member 20, the resilient pieces 30, and the plug contacts 40. In the illustrated embodiment, the frame portion 115 is substantially rectangular, and includes two linear first side walls 1151 parallel to each other, and curved second side walls 1153 connecting the two first side walls 1151. One first side wall 1151 defines two positioning cutouts 1155, and the opposite surfaces of each positioning cutout 1155 define a plurality of restricting grooves 1157. The positioning protrusion 117 is cylindrical, and formed on the second surface 1135. The positioning protrusion 117 is aligned with the assembly hole 1137. The cover 15 is substantially rectangular, and positioned on the frame portion 115 to seal the magnetic member 20, the resilient piece 30, and the plug contacts 40 in the receiving groove 1150. In the illustrated embodiment, the cover 15 forms a flange 151 to engage with the frame portion 115, thereby positioning the cover 15 on the frame portion 115.

Each magnetic member 20 is a rectangular magnet in this embodiment. The magnetic members 20 are received in the receiving groove 1150.

The resilient pieces 30 are made of conductive materials, and in this embodiment, the resilient pieces 30 are shaped strips of copper. Each resilient piece 30 includes a first plate 31 and a second plate 35 slanting upward from an end of the first plate 31. Each resilient piece 30 has a first connecting end 311 at the lower end thereof, and a second connecting end 351 extending from the higher end of the second plate 35. The two resilient pieces 30 are parallel, and are adhered to the connecting portion 113, with each second connecting end 351 attached to the top of a magnetic member 20. The resilient pieces 30 may be fixed to the connecting portion 113 via a plurality of fasteners, such as screws.

Each plug contact 40 is made of conductive material(s), and in this embodiment, the plug contact 40 is a shaped piece of copper. The two plug contacts 40 are positioned in the positioning cutouts 1155 of the frame portion 115. Each plug contact 40 includes an engaging portion 41, a contact portion 43, and a stepped portion 45. The engaging portion 41 is substantially rectangular. The contact portion 43 and the stepped portion 45 extend from opposite ends of the engaging portion 41, and the width of the contact portion 43 or the stepped portion 45 is smaller than that of the engaging portion 41. The engaging portion 41 is engaged in the restricting grooves 1157 of the frame portion 115. The stepped portion 45 is substantially in the shape of the letter "Z". The stepped portion 45 is partially positioned above the connecting end 351 of the resilient piece 30, and is not in contact with the connecting end 351.

The conductive member 50 includes a casing 51 and two conductive wires 53 exiting together from the casing 51. The casing 51 is substantially cylindrical, and extends through the assembly hole 1137 of the main body 11 and the positioning protrusion 117. The casing 51 is electrically connected to the power supply. Each conductive wire 53 is soldered to a first connecting end 311.

Figure 6:
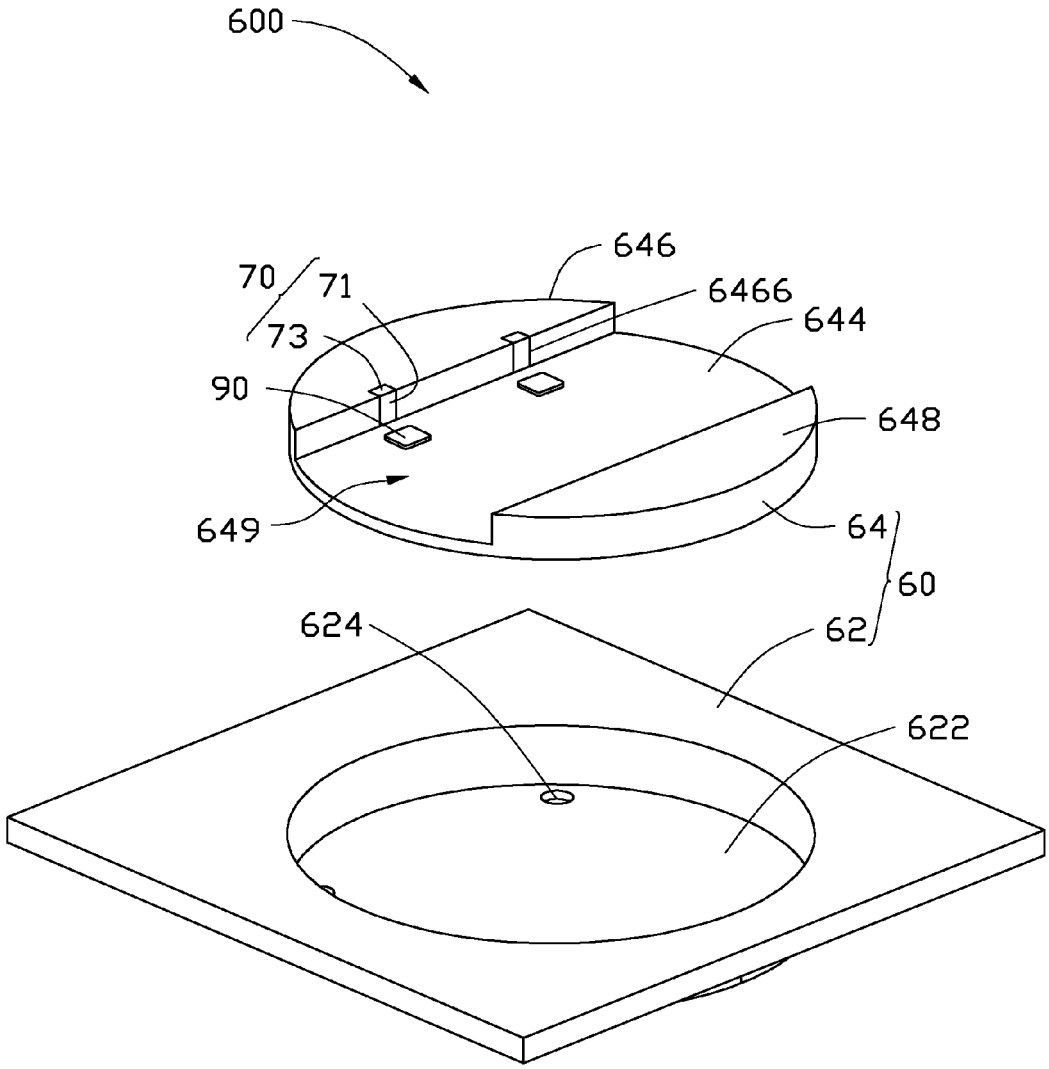
FIG. 6 is an exploded, isometric of the power socket of FIG. 1.
Figure 7:
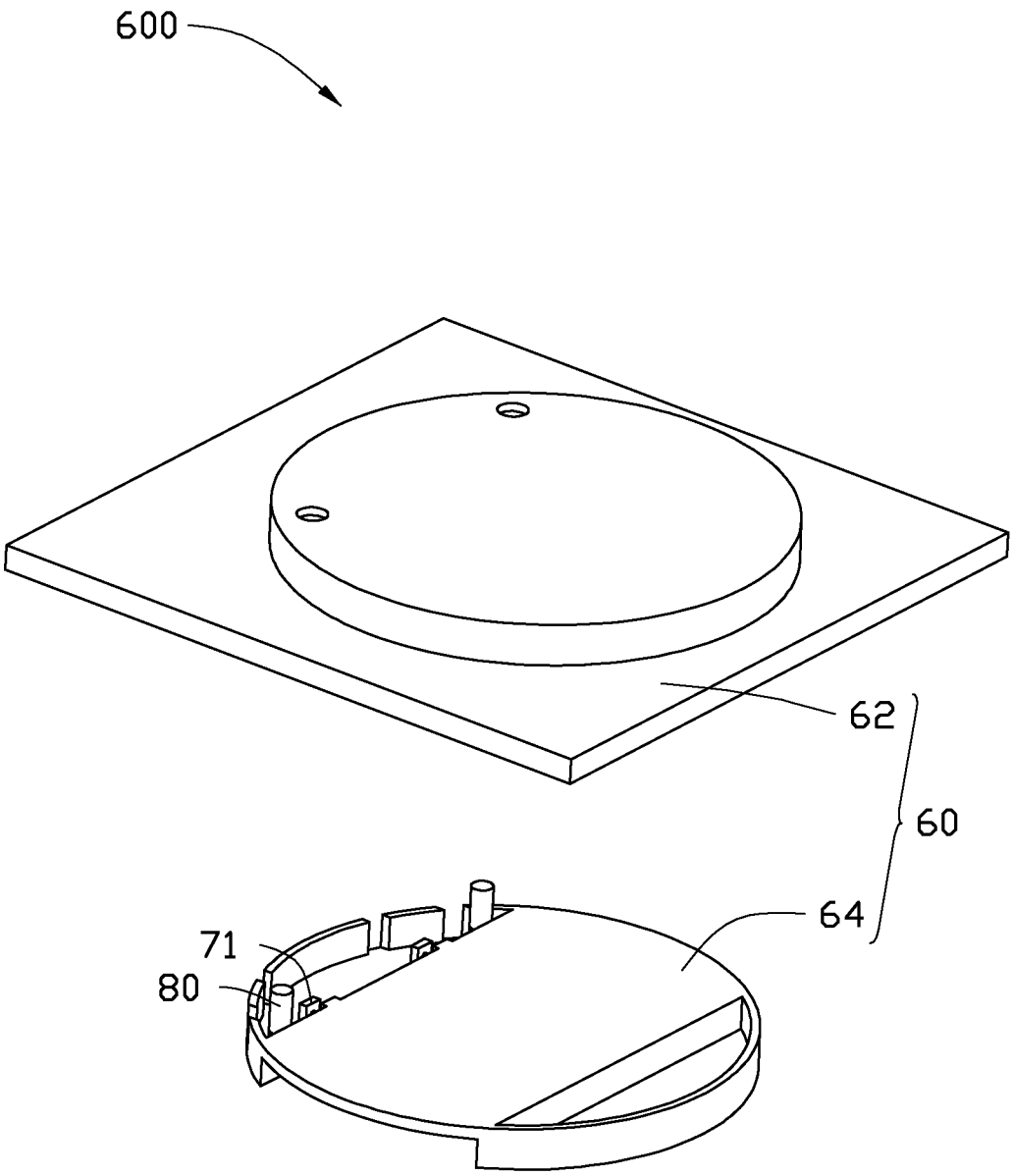
FIG. 7 is similar to FIG. 6, but viewed from another aspect.

Referring to FIGS. 6 and 7, the power socket 600 is affixed to the electronic device, and used together with the power plug 100. The power socket 600 includes a housing 60, two socket contacts 70, two conductive poles 80, and two metal pieces 90. The socket contacts 70, the conductive poles 80, and the metal pieces 90 are positioned in the housing 60. The power socket 600 may include three or more socket contacts 70, and the power socket 600 would have three or more corresponding metal pieces 90.

The housing 60 is made of insulating material, and includes an outer housing 62 and an inner housing 64 positioned in the outer housing 62. The outer housing 62 is substantially rectangular, and defines a circular groove 622 in the center portion thereof. The outer housing 62 further defines two through holes 624 in the bottom wall of the circular groove 622. The inner housing 64 is circular, and positioned in the circular groove 622. The inner housing 64 includes an engaging portion 644, a first support portion 646 and a second support portion 648. The first support portion 646 and the second support portion 648 are extended from opposite sides of the engaging portion 644. The engaging portion 644, the first support portion 646 and the second support portions 648 cooperatively define an assembly groove 649 for receiving the power plug 100. The first support portion 646 defines two L-shaped positioning grooves 6466 located opposite to the second support portions 648 for receiving the socket contacts 70.

Each socket contact 70 is made of conductive material(s), and in this embodiment, the plug contact 40 is a shaped piece of copper, that is substantially L-shaped. Each socket contact 70 includes a first contact portion 71 and a second contact portion 73 substantially perpendicular to the first contact portion 71. The socket contacts 70 are positioned in the positioning grooves 6466 of the first support portion 646, respectively.

The conductive poles 80 are substantially cylindrical. The conductive poles 80 extend through the through holes 624 of the outer housing 62, and are then connected to the electronic device. The conductive poles 80 are also electrically connected to the socket contacts 70. In the illustrated embodiment, the conductive poles 80 are soldered to the socket contacts 70.

Each metal piece 90 is a rectangular piece of iron in this embodiment. The metal pieces 90 are fixed to the engaging portion 644, and adjacent to the positioning grooves 6466. In the illustrated embodiment, the metal pieces 90 are attached to the engaging portion 644 by adhesive.

Referring to FIGS. 1 through 7, when the power plug 100 is not inserted into the power socket 600, the resilient pieces 30 are not in contact with the plug contacts 40. As a result, the electrical potential from the power supply can have no path to discharge electric power to the outside via the plug contacts 40. That is, if a user had touched the plug contacts 40 by accident, the user would not be in danger from electric shock by the electricity from the power supply even in damp or humid conditions. When the power plug 100 is inserted into the power socket 600, the frame portion 115 is sleeved on the engaging portion 644, and then the contact portions 43 of the plug contacts 40 are attached to the socket contacts 70. After that, the magnetic members 20 located opposite to the metal pieces 90 exert a magnetic force on the metal pieces 90 to attract the second connecting ends 351, such that the plug contacts 40 are only then electrically connected to the conductive member 50. As a result, the power plug 100 is electrically connected to the power socket 600.

The plug contacts 40 of the power plug 100 are exposed to the outside, and the plug contacts 40 have no electrical connection with the power supply when the power plug 100 is not inserted into the power socket 600. Therefore, a leakage of electricity cannot occur in the plug contacts 40. Only when the power plug 100 is coupled to the power socket 600, would the plug contacts 40 to be automatically electrically connect to the resilient pieces 30, due to the magnetic force between the magnetic member 20 and the metal pieces 90.

While the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure, as defined by the appended claims.

What is claimed is:

1. A power plug, comprising:

a housing;

at least two plug contacts positioned on the housing;

at least one conductive member positioned on the housing;

at least two conductive resilient pieces positioned in the housing, and electrically connected to the conductive member, wherein the at least two conductive resilient pieces are adjacent to the at least two plug contacts; and at least two magnetic members received in the housing, and each of the at least two magnetic members being attached to one of the at least two conductive resilient pieces.

2. The power plug of claim 1, wherein each of the at least two conductive resilient pieces comprises a first plate and a second plate extending from an end of the first plate, and the second plate is slanted to the first plate; the first plate is electrically connected to the conductive member; each of the at least two magnetic members is attached to the second plate.

3. The power plug of claim 2, wherein each conductive resilient piece further comprises a first connecting end extending slantingly from an end of the first plate away from the second plate, and each first connecting end is contacting the conductive member.

4. The power plug of claim 1, wherein the housing comprises a main body and a cover connected to the main body, the main body and the cover are made of insulation materials.

5. The power plug of claim 4, wherein the main body comprises a connecting portion, a frame portion formed on the connecting portion, the frame portion and the connecting portion cooperatively define a receiving groove for receiving the at least two magnetic members, the at least two conductive resilient pieces, and the at least two plug contacts.

6. The power plug of claim 5, wherein the frame portion defines at least two positioning cutouts, and the at least two plug contacts are positioned in the at least two positioning cutouts.

7. The power plug of claim 6, wherein each plug contact comprises an engaging portion, a contact portion, and a stepped portion, the contact portion and the stepped portion extend from opposite ends of the engaging portion, and a width of the contact portion or the stepped portion is smaller than the width of the engaging portion.

8. The power plug of claim 1, wherein the conductive member comprises a casing and two conductive wires extending from a same end of the casing, and the conductive wires are connected to the at least two conductive resilient pieces.

9. A power socket, comprising:

an inner housing comprising an engaging portion, a first support portion and a second support portions extending from opposite sides of the engaging portion, the engaging portion, the first support portion and the second support portions cooperatively defines an assembly groove;

at least two socket contacts positioned on the first support portion;

at least two conductive poles positioned on the engaging portion and electrically connected to the socket contacts;

at least two metal pieces positioned in the assembly groove of the inner housing, and adjacent to the at least two socket contacts.

10. The power socket of claim 9, further comprising an outer housing sleeved on the inner housing, and the conductive poles extend through the outer housing.

11. The power socket of claim 9, wherein the at least two socket contacts are substantially L-shaped.

12. An electrical connector, comprising:

a power plug, comprising:

a housing;

at least two plug contacts positioned on the housing;

at least one conductive member positioned on the housing;

at least two conductive resilient pieces positioned in the housing, and electrically connected to the conductive member, wherein the at least two conductive resilient pieces are adjacent to the at least two plug contacts; and at least two magnetic members received in the housing, and each of the at least two magnetic members being attached to one of the at least two conductive resilient pieces; and a power socket coupled to the power plug, comprising:

an inner housing defining an assembly groove partially receiving the housing of the power plug;

at least two socket contacts positioned on the inner housing;

at least two conductive poles positioned on the inner housing and electrically connected to the socket contacts; and at least two metal pieces positioned in the assembly groove of the inner housing, and opposite the at least two magnetic member of the power plug, such that a magnetic force generated between the at least two metal pieces and the at least two magnetic members drives the at least two plug contacts to attach to the at least two socket contacts.

13. The electrical connector of claim 12, wherein each of the at least two conductive resilient pieces comprises a first plate and a second plate extending from an end of the first plate and is slanted to the first plate; the first plate is electrically connected to the conductive member; each of the at least two magnetic members is attached to the second plate.

14. The electrical connector of claim 13, wherein a first connecting end extends slantingly from an end of the first plate away from the second plate.

15. The electrical connector of claim 12, wherein the housing comprises a main body and a cover connected to the main body, the main body and the cover are made of insulation materials.

16. The electrical connector of claim 15, wherein the main body comprises a connecting portion, a frame portion formed on the connecting portion, the frame portion and the connecting portion cooperatively define a receiving groove for receiving the at least two magnetic members, the at least two conductive resilient pieces, and the at least two plug contacts.

17. The electrical connector of claim 16, wherein the frame portion defines at least two positioning cutouts, and the at least two plug contacts are positioned in the at least two positioning cutouts.

18. The electrical connector of claim 17, wherein each plug contact comprises an engaging portion, a contact portion, and a stepped portion, the contact portion and the stepped portion extend from opposite ends of the engaging portion, and a width of the contact portion or the stepped portion is smaller than the width of the engaging portion.

19. The electrical connector of claim 12, wherein each conductive member comprises a casing and two conductive wires extending from a same end of the casing, and the conductive wires are connected to the at least two conductive resilient pieces.

20. The electrical connector of claim 12, wherein the power socket further comprises an outer housing sleeved on the inner housing, and the conductive poles of the power socket extend through the outer housing.

* * * * *